US009241206B2

(12) United States Patent
Nevill

(10) Patent No.: US 9,241,206 B2
(45) Date of Patent: Jan. 19, 2016

(54) DECOUPLED DRIVE UNIT FOR A LOUDSPEAKER ENCLOSURE

(71) Applicant: B & W GROUP LTD, West Sussex (GB)

(72) Inventor: Stuart Michael Nevill, Brighton Sussex (GB)

(73) Assignee: B & W GROUP LTD, West Sussex (GB)

( * ) Notice: Subject to any disclaimer, the term of this patent is extended or adjusted under 35 U.S.C. 154(b) by 0 days.

(21) Appl. No.: 14/362,673

(22) PCT Filed: Dec. 6, 2012

(86) PCT No.: PCT/GB2012/053039
§ 371 (c)(1),
(2) Date: Jun. 4, 2014

(87) PCT Pub. No.: WO2013/083989
PCT Pub. Date: Jun. 13, 2013

(65) Prior Publication Data

US 2014/0348369 A1 Nov. 27, 2014

(30) Foreign Application Priority Data

Dec. 6, 2011 (GB) ..... 1120960.8

(51) Int. Cl.
*H04R 1/28* (2006.01)
*H04R 1/02* (2006.01)
*H04R 15/00* (2006.01)

(52) U.S. Cl.
CPC ..... *H04R 1/02* (2013.01); *H04R 1/2896* (2013.01); *H04R 15/00* (2013.01); *H04R 1/025* (2013.01); *H04R 1/2815* (2013.01); *H04R 2207/00* (2013.01); *H04R 2217/00* (2013.01)

(58) Field of Classification Search
CPC ..... H04R 1/00; H04R 2205/022; H04R 2201/401; H04R 2201/405; H04R 1/28; H04R 1/2815–1/2826; H04R 9/00
USPC ..... 381/345, 349, 351, 182, 386, 398
See application file for complete search history.

(56) References Cited

U.S. PATENT DOCUMENTS 3,727,719 A * 4/1973 Yando ..... 381/349
4,301,332 A * 11/1981 Dusanek ..... 381/349

(Continued)

FOREIGN PATENT DOCUMENTS

EP 0 516 471 A1 12/1992
EP 2 384 024 A2 11/2011

(Continued)

OTHER PUBLICATIONS

International Search Report (PCT/ISA/210) mailed on Feb. 20, 2013, by the United Kingdom Patent Office as the International Searching Authority for International Application No. PCT/GB2012/053039.

(Continued)

*Primary Examiner* — Suhan Ni
(74) *Attorney, Agent, or Firm* — Buchanan Ingersoll & Rooney PC

(57) ABSTRACT

A loudspeaker enclosure defined by one or more panels housing a drive unit. The drive unit includes a coil, a diaphragm, and a magnet. The magnet is decoupled from the one or more panels of the loudspeaker enclosure. Sound is generated by the movement of the diaphragm and complementary movement of the magnet, on application of an appropriate electrical signal to the coil. The moving diaphragm acts against a first volume of air within the enclosure, while the movement of a surface coupled to the magnet, acts against a second air volume, different from the first volume. The surface coupled to the magnet is decoupled from the one or more panels of the loudspeaker enclosure.

19 Claims, 7 Drawing Sheets

(56) References Cited

U.S. PATENT DOCUMENTS

| | | | | |
|---|---|---|---|---|
| 4,939,783 | A * | 7/1990 | Dunning | 381/349 |
| 5,682,435 | A | 10/1997 | De Wit et al. | |
| 6,626,263 | B2 * | 9/2003 | Sahyoun | 381/349 |
| 6,704,426 | B2 * | 3/2004 | Croft, III | 381/351 |
| 7,454,025 | B2 * | 11/2008 | Saiki | 381/349 |
| 7,477,755 | B2 * | 1/2009 | Saiki et al. | 381/349 |
| 2005/0276434 | A1 | 12/2005 | Kobayashi et al. | |
| 2011/0268309 | A1 | 11/2011 | Moquin et al. | |

FOREIGN PATENT DOCUMENTS

| | | | |
|---|---|---|---|
| FR | 2 746 246 | A1 | 9/1997 |
| JP | 2001-239210 | A | 9/2001 |
| WO | WO 96/14722 | A1 | 5/1996 |
| WO | WO 2008/082304 | A2 | 7/2008 |

OTHER PUBLICATIONS

Written Opinion (PCT/ISA/237) mailed on Feb. 20, 2013, by the United Kingdom Patent Office as the International Searching Authority for International Application No. PCT/GB2012/053039.

United Kingdom Search Report issued on Mar. 27, 2012 in GB1120960.8.

A. Jones, "Loudspeaker Driver De-Coupling", Pioneer Electronics Tech., Posted on Mar. 27, 2010, pp. 1-8.

* cited by examiner

DECOUPLED DRIVE UNIT FOR A LOUDSPEAKER ENCLOSURE

BACKGROUND OF THE INVENTION

The present invention concerns loudspeakers. More particularly, but not exclusively, this invention concerns a loudspeaker enclosure housing a decoupled drive unit for a loudspeaker enclosure.

A conventional moving coil loudspeaker cabinet 102 is shown in FIG. 1. This utilises a diaphragm 104 driven by a coil 106 reacting against a field produced by a magnet 108. The coil 106 vibrates the diaphragm 104 in sympathy with an applied electrical signal to create a sound. The out of phase sound emanating from the rear of the diaphragm 104 that would otherwise interfere with this sound is trapped inside the volume interior 110 of the cabinet 102. This volume 110 acts as an air spring that resists the motion of the diaphragm 104. To counteract this force the magnet 108 may be rigidly held by a chassis 114 which fixes the loudspeaker in the cabinet. The chassis 114 consists of legs or a perforated cone, allowing the diaphragm 104 to radiate sound into the cabinet 102. When designing a loudspeaker unit, consideration needs to be given not only to the effects that arise from the air spring effect of the volume 110, but also the forces arising from the acceleration and vibration of the diaphragm. This vibrational energy excites the magnet 108 in anti-phase to the diaphragm 104 and some of this vibrational energy will travel via the chassis 114 to the panels of the cabinet 102. The cabinet 102 will then act as a secondary sound source whose output is dependent on its own mass, stiffness and surface area. It is not practical to make the cabinet radiate as a rigid body, so resonances are common. This output is generally seen to be undesirable and many steps are taken to reduce it.

One such way of reducing the transmission of vibrational energy from the magnet to the cabinet is to decouple the magnet from the cabinet by means of a resilient mounting ring. Such a decoupled loudspeaker unit is shown in FIG. 2, which shows a cabinet 202, with a coil diaphragm 204, coil 206, magnet 208, interior volume 210 and chassis 214 much like the unit shown in FIG. 1. The resilient mounting ring 216 connects the chassis 214 to the cabinet 202 and therefore decouples the chassis 214, and therefore the magnet 208, from the cabinet 202. This solution works well if the internal volume 210 is very large relative to area of the diaphragm 204 or if the diaphragm 204 is not significantly affected by the stiffness of the air spring 210. Below midrange frequencies the stiffness of the air spring 210 is often significant. If the air spring's stiffness is significant, relative to the resilience of the mounting, then the magnet 208 will move in addition to or even in preference to the diaphragm 204, resulting in a loss of and/or distortion in acoustic output.

The present invention seeks to mitigate the above-mentioned problems. Alternatively or additionally, the present invention seeks to provide an improved loudspeaker enclosure.

SUMMARY OF THE INVENTION

The present invention provides a loudspeaker enclosure housing a drive unit, preferably a bass or mid-bass drive unit, wherein the drive unit comprises a coil, a magnet and a diaphragm. The magnet is decoupled from the loudspeaker enclosure. The diaphragm is arranged to move, and thereby generate sound, on application of an appropriate electrical signal to the coil, which also causes a complementary movement of the magnet. The diaphragm is arranged such that when moved by such an electrical signal it acts against a first air volume within the enclosure. The diaphragm is preferably supported on a first chassis. The magnet is arranged such that when moved by such an electrical signal a surface coupled to the magnet acts against a second air volume, different from the first air volume. The surface coupled to the magnet is also decoupled from the body of the loudspeaker enclosure. The body of the enclosure is typically defined by one or more panels.

In contrast to previous proposals for decoupled drive units for loudspeaker enclosures, the present invention both decouples the magnet from the enclosure but also ensures that as the diaphragm acts against a first volume of air during its movement, the magnet, as a result of being coupled to an appropriately configured surface, effectively acts against a second volume of air. Such an arrangement facilitates better control of the sympathetic vibration of the magnet, either harnessing it for the purpose of increasing output levels or reducing the magnet vibration and/or its affect on sound quality, as is explained further below.

It will of course be appreciated that if the magnet is both coupled to the surface which acts against the second air volume and decoupled from the body of the loudspeaker enclosure and/or the panels defining the enclosure, then it may follow that said surface will inherently also be decoupled from said one or more panels of the loudspeaker enclosure.

It will be understood that in the context of a drive unit for a loudspeaker the issue of whether a first object is coupled to, or decoupled from, a second object is judged over a particular acoustic frequency range. The frequency range of relevance will be one that covers all frequencies likely to give rise to undesirable vibration of parts of the loudspeaker enclosure. The decoupling of one physical thing from another in the context of the present invention may be considered as equivalent to vibrationally decoupling the things. Thus, two items that are decoupled from each other in the context of the present invention may nonetheless be in indirect contact with each other. Indeed, as described below in further detail, it may be preferred that items that are decoupled from each other are physically joined to each other by a means that provides the decoupling. Given that physical systems rarely behave perfectly it will also be appreciated that the decoupling of one object from another in accordance with the present invention will typically not provide perfect decoupling of one object from another.

The one or more panels may be flat-panels, but may in some embodiments be curved. The panels may have a thickness that is different at different portions of the panel, but it may be convenient for the panels to have a substantially constant thickness. The second volume may be to the exterior of the enclosure. The second volume may be defined by atmospheric air in the region of the local environment of the enclosure. It will be appreciated that in such a case the second volume would typically be larger than the first volume. In the case where the surface coupled to the magnet acts on a volume of air to the exterior of the loudspeaker, it may be utilised to produce sound in-phase with the sound produced by the front diaphragm. In such a case, the surface may be designed to improve the quality of the sound produced so that it matches and/or complements the sound produced by the diaphragm. The surface to which the magnet is coupled may be accommodated within an aperture defined by the rear panel of the enclosure. The surface may be defined by means of a portion of the rear panel of the enclosure.

The second volume may be smaller than ten times the first volume. The second volume may be smaller than the first volume. The first volume is preferably a closed volume. The first volume is preferably sealed. The first volume is preferably arranged such that in use it acts as an air spring, against which the diaphragm acts in use. If the first volume were vented in any way then such a vent might require the provision of damping and/or the acoustic resistance therein. The first volume may be provided with a reflex port, but in acoustic terms still be considered as "closed".

The second volume may be located within the enclosure. Such an arrangement allows a more flexible solution that may be of application in a wider variety of environments. In the case where the second volume is in the cabinet, the magnet may be arranged such that when moved by such an electrical signal a further surface coupled to the magnet also acts against the first air volume. Thus, as an example, the magnet may have a first front surface that acts against the first volume and a second rear surface that acts against the second volume. It will, from this example, be appreciated that it is within the scope of the present invention for the magnet to be coupled to the surface by means of the surface being defined by the body of the magnet or a part thereof.

Preferably, particularly when the second volume is within the enclosure, the second volume is vented. The second volume is preferably vented to the outside of the enclosure. The second volume may be vented to the front of the enclosure. Additionally, or alternatively, the second volume may be vented to the rear of the enclosure. Venting the second volume provides a means of damping of, and/or reducing the stiffness of, the air spring effect of the second volume. The venting of the second volume may be in the form of a vent that includes means for providing acoustic resistance. For example, the vent may include material that provides acoustic resistance, such as a mesh, wadding, nested tubes, sintered metal balls, or the like. Additionally, or alternatively, acoustic resistance may be provided by means of the arrangement or configuration of the vent. For example, the vent may include a simple slit, a constriction to the airflow, and/or a long and convoluted shape. Provision of acoustic resistance in the venting arrangement may assist, during the design process, in setting a suitable decoupling transfer function, which in turn has an effect on the likely relative motion of cabinet and speaker. The present invention may be of application in a case where the second volume is within the enclosure but not vented. In such a case, it may be preferred for the second volume to have a volume that is comparable to, and possibly larger than, the first volume.

The second volume may have a depth that is less than ten times the maximum excursion that the magnet is expected to make during normal operation. The second volume may have a depth that is less than five times the maximum excursion that the magnet is expected to make during normal operation.

The loudspeaker enclosure may be arranged such that the complementary movement of the magnet is of the same order of magnitude as the movement of the diaphragm reduced in proportion to the mass ratio of the magnet to the diaphragm. Thus, if the diaphragm experiences a displacement of about 25 mm and has a mass about 25 times less than that of the magnet, then the complementary movement of the magnet may be of the order of 1 mm. If the magnet were braced or otherwise rigidly coupled to the enclosure then one might expect reduced complementary movement of the magnet, but more movement and/or undesirable vibration of the enclosure. It has been found, surprisingly, that for relatively small excursions of the magnet, performance of the loudspeaker unit is not significantly compromised. Linearity of the system might be affected for relatively large excursions of the magnet, but such large excursions (significantly greater than 1 mm) are not envisaged in view of the likely mass ratio of the magnet to the diaphragm.

The surface to which the magnet is coupled may be defined by means of a structure that shows a surface area to the second volume of air that is comparable to surface area of the diaphragm. Such an arrangement may be of benefit when the surface radiates sound from the enclosure (for example, when the second volume is to the exterior of the enclosure). It may also be of benefit when the second volume is within the enclosure, as it effectively provides better balance and matching as between the forces acting on the surface (coupled to the magnet) and the forces acting on the diaphragm. The surface may be defined by a structure that has a shape that is comparable to the shape of the diaphragm.

Above, it is stated that the surface to which the magnet is coupled may actually be defined by the body of the magnet itself, or a part thereof. It is preferred however for the surface to be defined by structure distinct from the magnet. The surface may for example be a non-magnetic extension of the structure of the magnet. The surface may be defined by a structure that supports and/or accommodates the magnet. The surface may be coupled to the magnet via one or more struts. The surface may be defined by means of a structure that resembles a piston, which is coupled to the magnet. The piston structure may for example comprise a central rod that extends from the magnet to the surface, the rod being generally perpendicular and centrally disposed relative to the surface. The central rod may be considered as being an example of the one or more struts mentioned above.

A resilient mounting may provide the means for decoupling the magnet from the body of the loudspeaker enclosure, and/or one or more panels defining the enclosure. A resilient mounting may provide the means for decoupling the surface coupled to the magnet from the body of the loudspeaker enclosure, and/or one or more panels defining the enclosure. It may, in certain embodiments, be feasible for there to be just one such resilient mounting for providing the decoupling of both the magnet and the surface coupled to the magnet from the enclosure. It is convenient however, in most of the envisaged embodiments, for there to be at least two separate resilient mountings, a first for decoupling the magnet from the one or more panels of the loudspeaker enclosure and a second for decoupling the surface coupled to the magnet from the one or more panels of the loudspeaker enclosure. The or each resilient mounting may be generally ring shaped. The or each resilient mounting may be of rubber or flexible polymeric material. The or each resilient mounting may be a silicone member. Silicone is typically preferred as it tends to exhibit less creep than other rubber materials.

Preferably a first resilient mounting is be provided between the magnet and one or more panels of the loudspeaker enclosure. Preferably a second, separate, resilient mounting is provided between the surface coupled to the magnet and said one or more panels of the loudspeaker enclosure. The first resilient mounting, between the magnet and one or more panels of the loudspeaker enclosure, and the second resilient mounting provided between the surface coupled to the magnet and said one or more panels of the loudspeaker, may be placed directly between such parts. Other items may however also be placed in the acoustic path that would otherwise exist between the parts decoupled by means of the resilient mountings. For example, in one embodiment of the invention described below, the diaphragm is supported on a chassis, and the decoupling of the magnet from the panel(s) is provided by means of the chassis being attached to the enclosure via a resilient mounting. The resilient mounting connecting such a chassis (for example the aforementioned first chassis on which the diaphragm may be supported) to the enclosure may be positioned rearwardly of the front panel of the enclosure. More generally, the foremost resilient mounting for decoupling the magnet or surface coupled to the magnet from the enclosure may be recessed, and therefore may be positioned rearwardly of the front panel of the enclosure.

As mentioned above, the diaphragm may be supported on a first chassis. There may also be a second chassis. For example, the second chassis may hold, but be decoupled from, the surface that is coupled to the magnet. The magnet is preferably decoupled from the second chassis. The surface coupled to the magnet may be decoupled from, and accommodated within, the loudspeaker enclosure (and/or the panel(s) thereof) by means of the surface being fixed to the second chassis via a resilient mounting. The first chassis may be connected to, but decoupled from, the second chassis. The second chassis may be wider (for example, by having a larger diameter) than the first chassis. The first chassis may be arranged to be circumferentially surrounded by the second chassis. The second chassis may comprise one or more leg members arranged circumferentially about the magnet. The second chassis may define one or more vents for venting the second volume, for example to a region exterior to the enclosure. The vents may be provided at least partially within said leg members mentioned above. It will be appreciated that it is within the scope of the present invention to have a loudspeaker enclosure where there is only one chassis possessing all or any of the features of the afore-mentioned "second chassis" but without the provision of the "first chassis" (the diaphragm being held by other means).

The magnet will typically be positioned rearwardly (in the direction front to back of the enclosure) of the diaphragm. In applications where the maximum depth of the enclosure is limited (for example in the case of an in-wall enclosure), it may be preferable for an inverted arrangement to be used, in which the magnet is positioned forwardly of the diaphragm. In such a case, the magnet may be so arranged that sound may be permitted to radiate from the diaphragm at least partially through the magnet, typically through an aperture in the centre of the generally annularly-shaped magnet.

The enclosure may accommodate further drive units in addition to the drive unit mentioned above. Thus two or more drive units may thus share the same enclosure. The enclosure may be divided into two or more sub-enclosures.

The loudspeaker enclosure may be in the form of a cabinet, for example a free-standing loudspeaker cabinet.

The loudspeaker enclosure may be in the form of an in-wall loudspeaker installation. As mentioned above, there may be one or more panels forming the enclosure. The one or more panels may be defined by one of more surfaces of a cavity provided in the wall in which the loudspeaker assembly is installed.

The present invention also provides a kit for making an in-wall loudspeaker installation as described or claimed herein. The kit may include a drive unit (for example a bass or mid-bass drive unit) comprising a coil, a magnet and a diaphragm, the diaphragm being arranged to move, and thereby generate sound, on application of an appropriate electrical signal to the coil, which also causes a complementary movement of the magnet. The kit may include one or more fixings for mounting the magnet within the wall in a manner that decouples the magnet from the wall. The kit may include one or more structural elements, for example comprising one or more panels, for dividing the cavity into a first volume and a second volume, the kit being so arranged that once the loudspeaker is installed in the cavity, the diaphragm acts against the first air volume when moved by such an electrical signal and a surface coupled to the magnet against a second air volume, different from the first air volume, when moved by such an electrical signal.

It will of course be appreciated that features described in relation to one aspect of the present invention may be incorporated into other aspects of the present invention. For example, the method of the invention may incorporate any of the features described with reference to the apparatus of the invention and vice versa.

DESCRIPTION OF THE DRAWINGS

Embodiments of the present invention will now be described by way of example only with reference to the accompanying schematic drawings of which.

DETAILED DESCRIPTION

Figure 1:
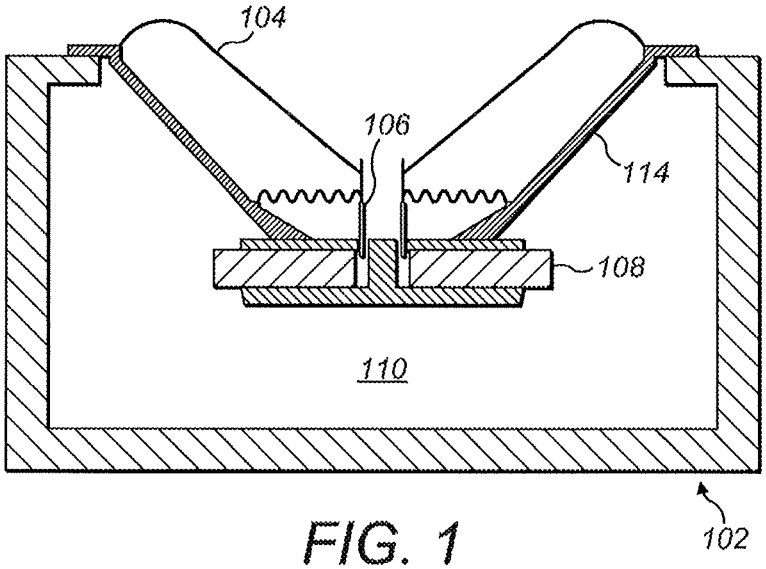
FIG. 1 (Prior art)
FIG. 1 shows a section through a loudspeaker cabinet according to the prior art.
Figure 2:
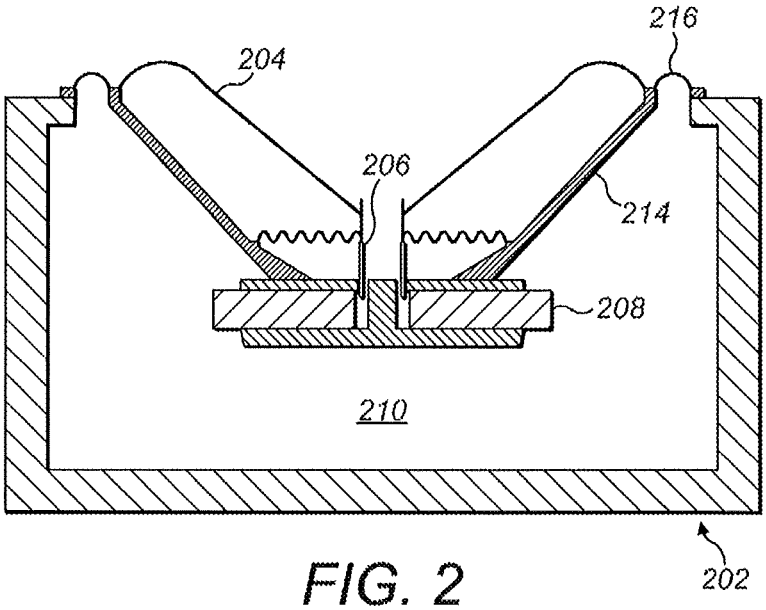
FIG. 2 (Prior art)
FIG. 2 shows a section through a loudspeaker cabinet according to the prior art.
Figure 3:
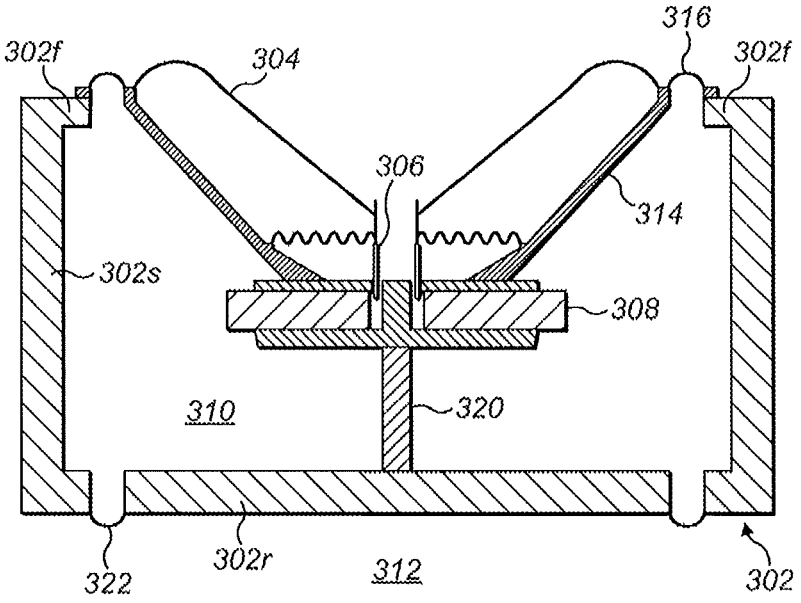
FIG. 3 shows a section through a loudspeaker cabinet according to a first embodiment of the invention.

A balanced decoupled loudspeaker cabinet 302 according to a first embodiment is shown in FIG. 3. The exterior of the generally cuboidal cabinet 302 is formed by six panels including side panels 302*s*, a rear panel 302*r* and a front panel 302*f*. The loudspeaker cabinet 302 includes a mid-bass drive unit, which comprises a diaphragm 304 driven by a coil 306 reacting against a field produced by a magnet 308. The coil 306 vibrates the diaphragm 304 in sympathy with an applied electrical signal to create a sound. Sound radiates from the diaphragm forwardly through the aperture in the front panel 302*f* of the cabinet 302. The magnet 308 is housed in a chassis 314 that is physically connected to, but vibrationally decoupled from, the front panel 302*f* by means of a resilient mounting 316, in the form of a silicone ring. The magnet 308 is therefore effectively decoupled from the cabinet 302.

A first volume 310 in the cabinet 302 acts as an air spring such that, on application of an appropriate electrical signal to the coil, the diaphragm acts against the air spring defined by the first volume 310. Movement of the diaphragm causes complementary movement of the magnet 308. The rear surface of the magnet 308 is connected to a piston arrangement comprising a rod 320 and a portion of the rear panel 302*r*. Thus, the complementary movement of the magnet is effectively reacted against a second air volume 312, namely the air exterior of and to the rear of the cabinet. It will of course be appreciated that the magnet 308 also acts against the air spring defined by the first volume 310 of air. The rear panel 302*r* coupled with the rod 320 and magnet 308, is itself connected to, but decoupled from, the cabinet 302 by means of a further resilient mounting 322. The rear panel 302*r* moved by the magnet has approximately the same size and shape as the diaphragm 304 at the front of the speaker.

The coil 306 reacts against the magnet 308 with a much reduced loss of output to the speaker diaphragm 304. Any loss is also compensated for by acoustic output of the piston-rear surface 302*r*, which radiates acoustically in phase with the speaker diaphragm 304. Thus, not only is the problem associated with vibration of the magnet coupling with the cabinet and causing distortion and undesirable noise mitigated, but moreover, the vibration of the magnet is utilised to produce complementary sound waves from the rear surface that could enhance and increase sound output.

Figure 4:
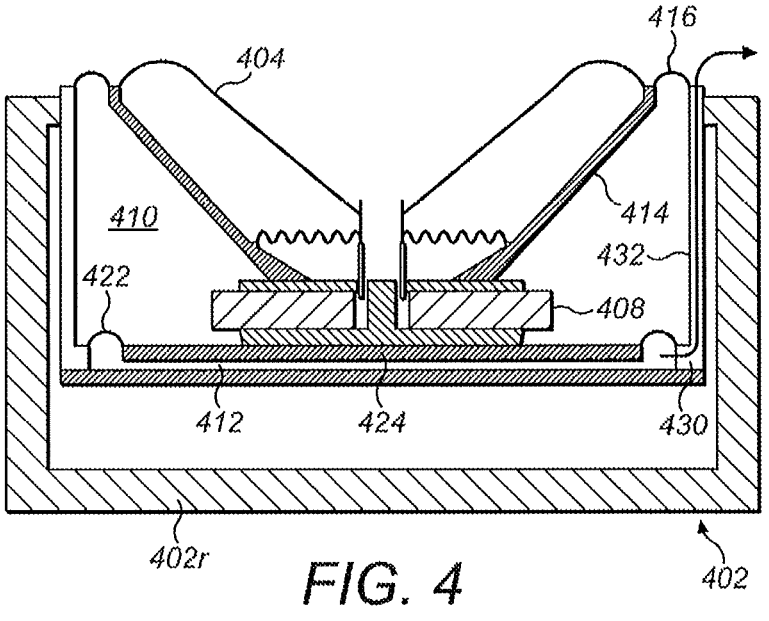
FIG. 4 shows a section through a loudspeaker cabinet according to a second embodiment of the invention.

A second embodiment of a balanced decoupled loudspeaker cabinet 402 is shown in FIG. 4, which is based around a 15" (~380 mm) bass unit. The second embodiment also differs from the first in that the rear surface of the cabinet is not used to radiate sound. There is therefore no need for a moveably mounted rear panel to be provided in the rear of the cabinet, which may therefore simplify construction and/or effective use of the loudspeaker unit. The magnet 408 in this case is in the form of a (relatively heavy) ceramic magnet. The magnet 408 is housed in a first chassis 414 that is decoupled from the cabinet 402 by means of resilient mounting 416. The first chassis 414 supports the diaphragm 404. An interior panel 424 is connected to and coupled with the rear of the magnet 408. The interior panel 424 is physically connected to, but decoupled from, a second chassis 430. The second chassis 430 is connected directly to the cabinet 402 and such that its rearmost portion is mounted forward of the rear panel 402*r*. The resilient mounting 416 which decouples the magnet 408 from the cabinet 402 is positioned at the front of the cabinet and actually extends from the first chassis 414 to the second chassis 430.

In this second embodiment, the interior of the cabinet 404 is divided into two volumes of air: a first volume 410 between the rear of the diaphragm 404 and the front of the interior panel 424 and a second volume 412 between the rear of the interior panel 424 and the rearmost part of the second chassis 430. This second volume 412 is vented to the front of the cabinet 402 by means of hollow legs 432 of the second chassis 320. In the second embodiment, movement of the magnet is not therefore used to generate complementary sound output. The entire assembly (comprising the drive unit and both chassis) can be inserted into the cabinet from the front face only. The interior panel 424 radiates into the second volume 412, which is relatively small as it needs only to allow for the excursion required to decouple the magnet 408 effectively. The mass of the magnet is about 10 Kg whereas the mass of the diaphragm is about 0.2 Kg Thus, in view of an expected maximum excursion of the diaphragm of 25 mm, it is expected that the expected maximum excursion of the magnet will be of the order of 0.5 mm. In this case, the depth of the second volume 412 is about 5 mm. In this embodiment, the first volume is about 0.1 $m^3$, and the second volume (including the vents defined by the hollow legs 432) is very roughly of the order of 0.005 $m^3$.

Figure 5:
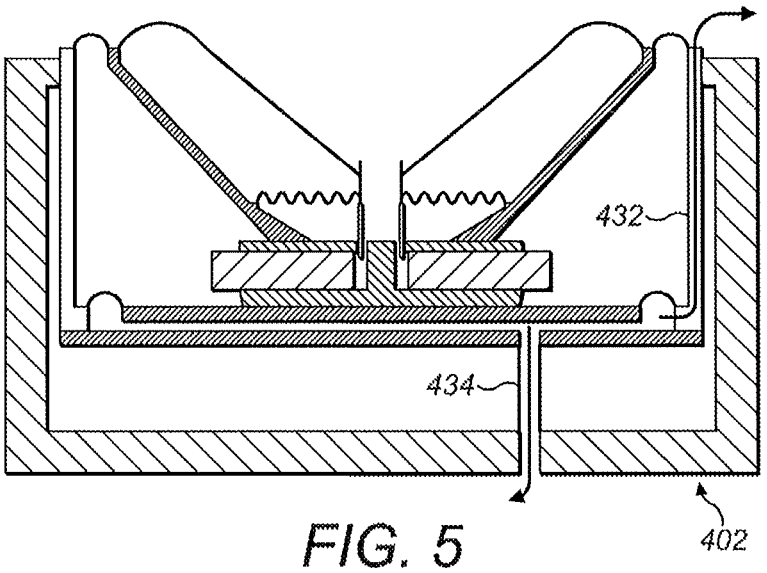
FIG. 5 shows a section through a loudspeaker cabinet according to a third embodiment of the invention.

FIG. 5 shows a third embodiment which illustrates a variation of the second embodiment. In addition to the vent 432 to the front of the cabinet 402, there is provided a rear passageway 434 which also vents the second air volume 412 to a region to the rear of the cabinet 402. It will be appreciated that, as a further variation, the forward venting vent of the second embodiment could be dispensed with entirely, with a rear vent similar to this third embodiment being provided.

Figure 6:
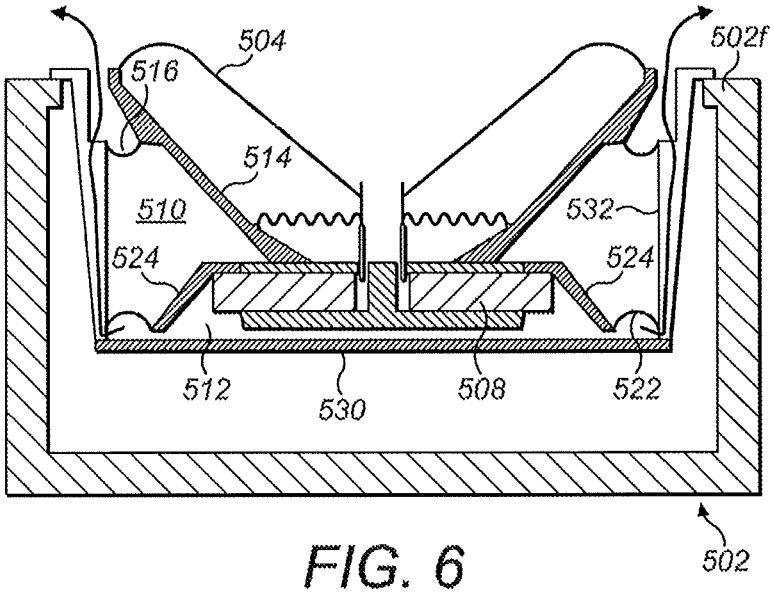
FIG. 6 shows a section through a loudspeaker cabinet according to a fourth embodiment of the invention.

FIG. 6 shows a fourth embodiment, which is similar to the second embodiment. Thus, there are first and second volumes 510, 512 defined in the cabinet 502 and there are vents defined at least partly by hollow legs 532 of the second chassis 530 for venting the second volume 512, and there is no rear vent. The first chassis 514 is connected to but decoupled from the second chassis 530. The main differences will now be described. The interior panel for reacting against the second volume is now defined by a conical extension 524 of the magnet structure 508. Such a structure reduces complexity in that effectively one fewer part is required. Such a structure can also provide better balance in the arrangement, as the shape and behaviour of the conical extension 524 are more like that of the diaphragm 504. The diameter of the second chassis 530 tapers towards its rear to make it more compatible with existing round chassis designs. The forward decoupling suspension 516 is recessed and positioned rearwardly of the front panel 502*f*. The vents defined in the hollow legs 532 of the second chassis 530 are arranged to vent the second volume into the space above the decoupling suspension 516 and then via the small clearance between the first and secondary chassis 514, 530.

Figure 7:
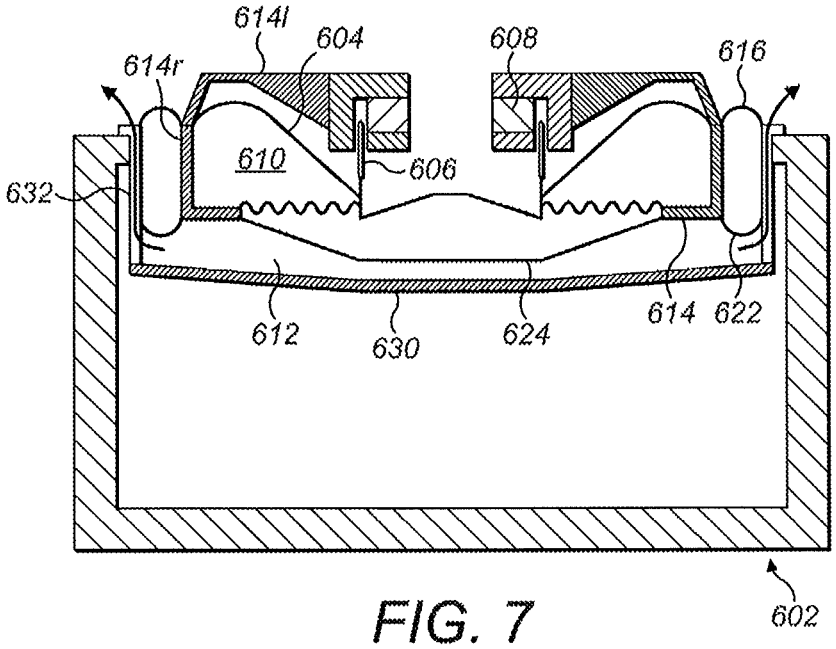
FIG. 7 shows a section through a loudspeaker cabinet according to a fifth embodiment of the invention.

FIG. 7 shows a loudspeaker cabinet 602 according to a fifth embodiment. In this embodiment, the loudspeaker drive unit comprising the first chassis 614, magnet 608, coil 606 and diaphragm 604 are arranged in inverted formation and the enclosure 602 is designed for installation in a cavity in a wall of a building, for example a house, cinema, recording studio or the like. The first chassis 614 has a open structure defined by four legs 614*l* extending inwardly from an annular ring structure 614*r*. The diaphragm 604 is positioned rearwardly of the legs and sound radiates though the open regions between the legs 614*l*. The first chassis 614 holds the magnet 608 and is also connected to and coupled with an interior panel 624. The second chassis 630 is coupled and connected to the front of the cabinet by means of a conventional bond. The legs of the second chassis 630 are hollow and define vents 632 for venting air to and from the second volume 612. The first chassis 614 is connected to the second chassis via front and rear decoupling mountings 616, 622. The inverted nature of the arrangement allows the cabinet to be more shallow (less depth) making the arrangement potentially more suitable for an in-wall installation.

Figure 8A:
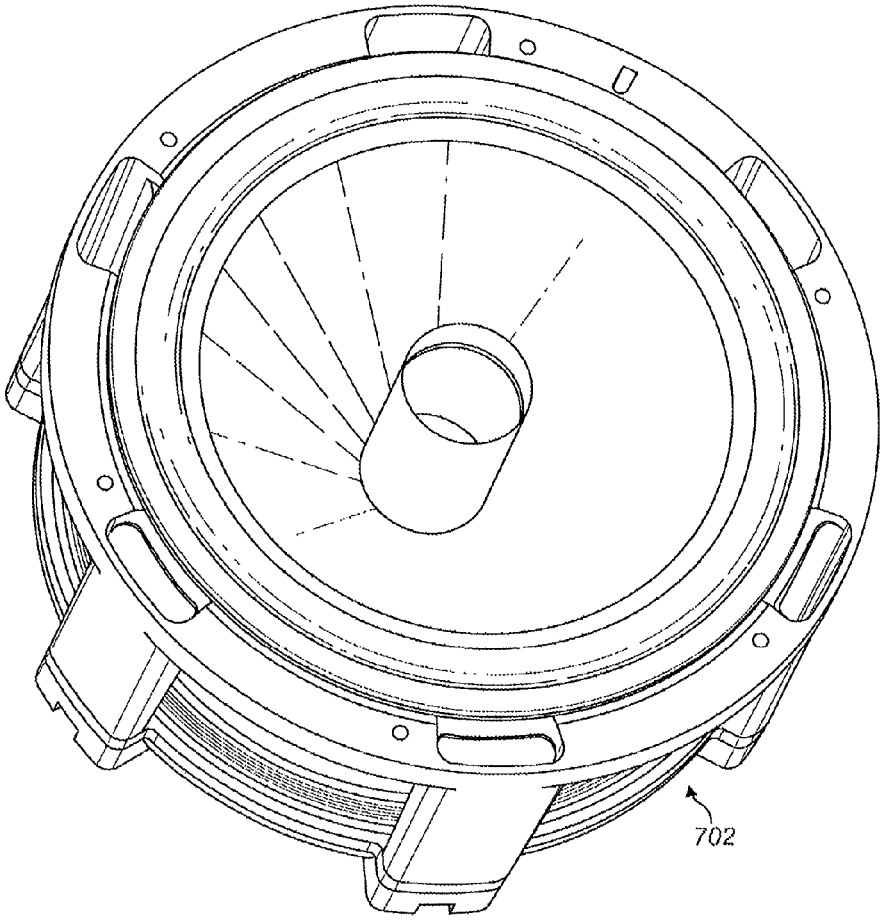
FIGS. 8*a*, 8*b* and 8*c* show a loudspeaker unit according to a sixth embodiment of the invention.
Figure 8B:
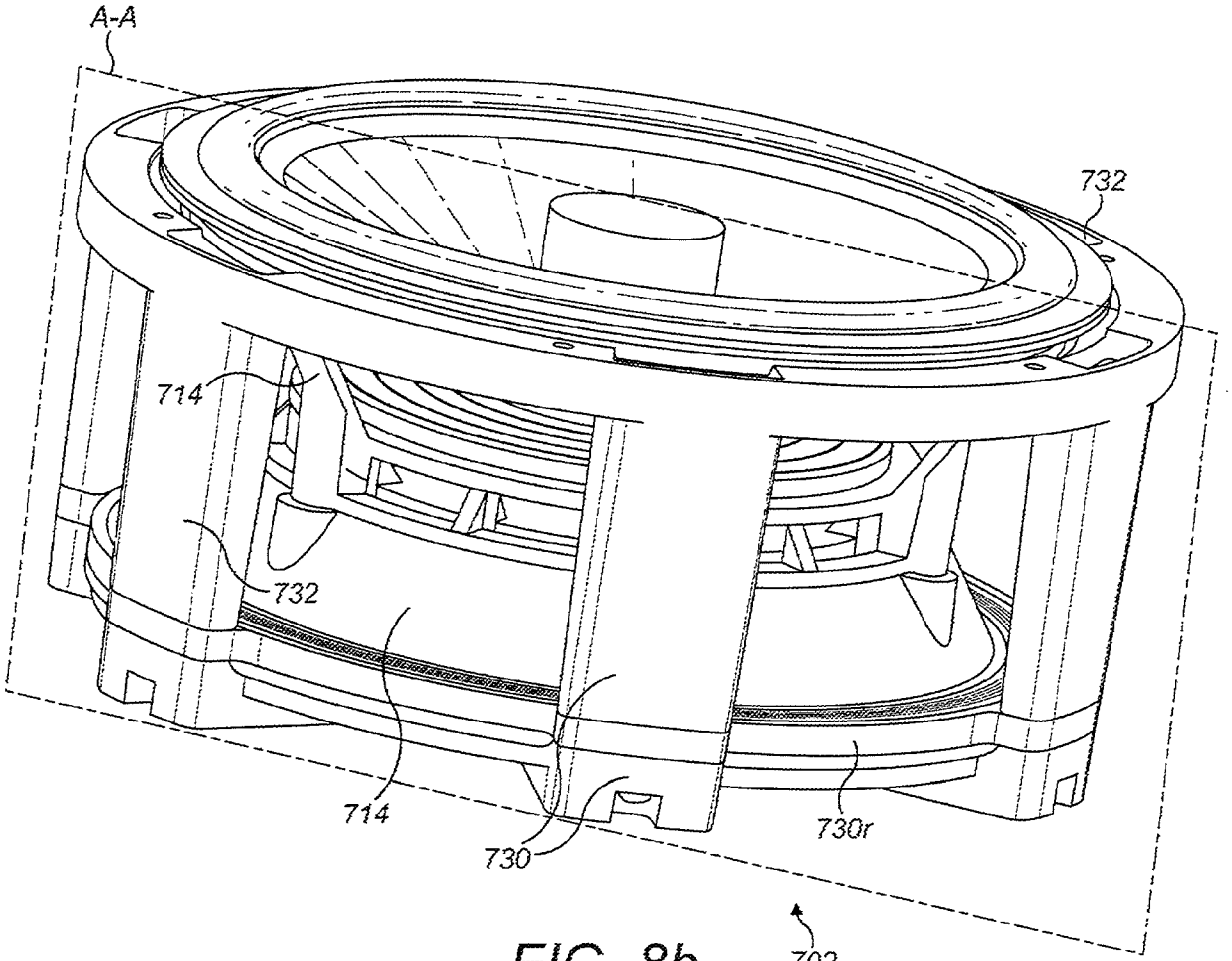
Figure 8C:
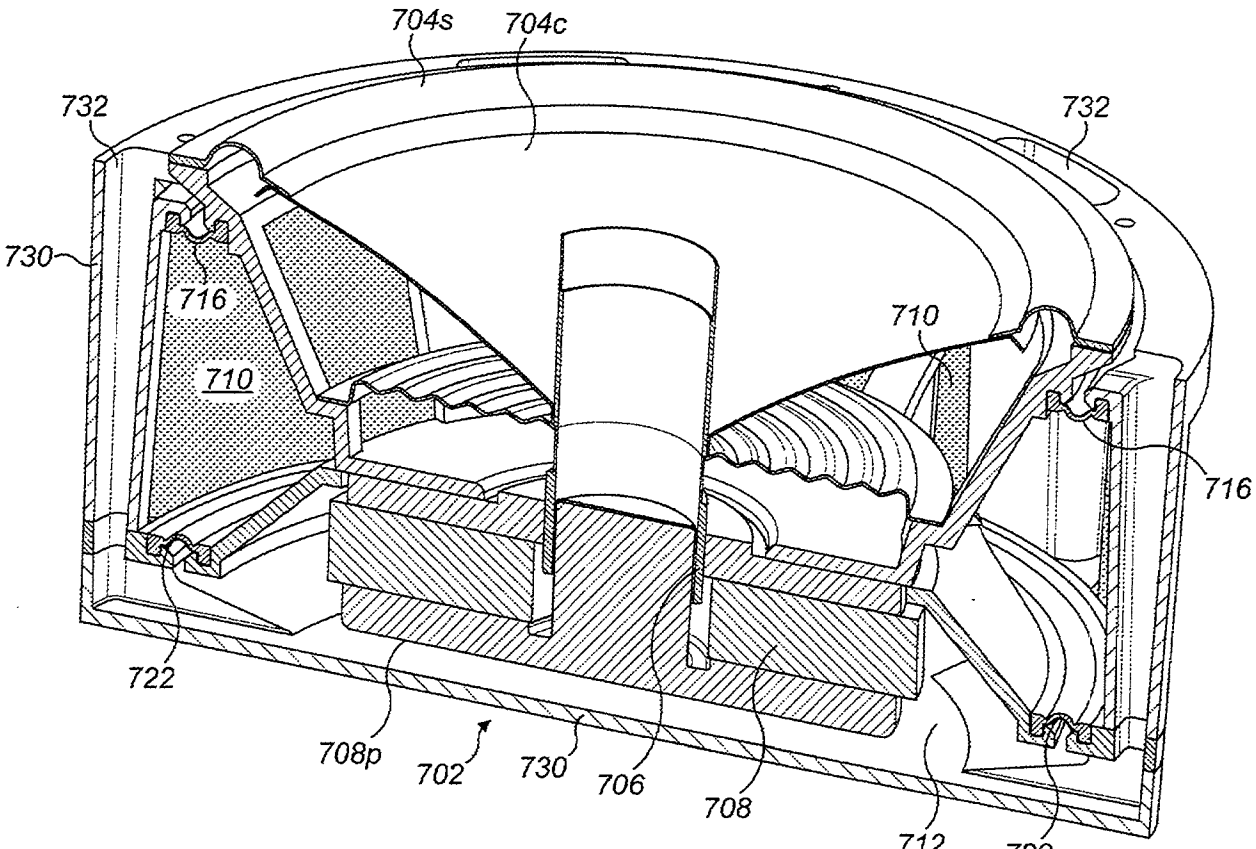

A balanced decoupled loudspeaker drive unit 702 according to a sixth embodiment is shown in FIGS. 8*a*, 8*b* and 8*c*. FIG. 8*a* shows the drive unit 702 in perspective as viewed from the front. FIG. 8*c* shows a 3-d computer model of the unit 702 in a schematic cut-away view. The plane A-A, through which the section of FIG. 8*c* is taken, is shown in FIG. 8*b*. The general configuration of the drive unit 702 is similar to that of the fourth embodiment shown in FIG. 6. Thus, there are first and second volumes 710, 712 defined in the unit 702. The second volume 712 vents to the front of the unit via hollow supports 732 (see FIG. 8*c* in particular) and there is no rear vent. The first volume 710 is enclosed by means of panels of the loudspeaker enclosure (not shown in FIGS. 8*a* to 8*c*). The bottom of the magnet is attached to, and therefore coupled mechanically to, a metal pole-piece and plate 708*p*. The underside of the pole-piece and plate 708*p* acts against the second volume 712 in use. There is a first (inner) chassis 714, formed of an upper and a lower part, which supports the diaphragm 704 (in the form of its cone 704*c* and its associated surround 704*s*). The diaphragm 704 acts against the first air volume 710 in use. A second (outer) chassis 730 is formed from an upper part and a lower part, joined by an isolating ring 730*r*. The first chassis 714 is connected to but decoupled from the second chassis 730 by means of an upper decoupling suspension ring 716 and a lower decoupling suspension ring 722. It will be appreciated that the lowermost surfaces of the inner chassis 714 (i.e. of the lower part) will also act against the second volume 712 in use. FIG. 8*c* shows the voice coil 706 of the drive unit in section.

It will be seen that the magnet 708, its associated plate 708*p* (which in use acts against the second volume 712) and indeed the entire inner chassis 714, are all decoupled from the outer chassis 730 and therefore also decoupled from the panels (not shown) of the loudspeaker enclosure, in which the second chassis may be mounted.

Whilst the present invention has been described and illustrated with reference to particular embodiments, it will be appreciated by those of ordinary skill in the art that the invention lends itself to many different variations not specifically illustrated herein. By way of example only, certain possible variations will now be described.

The rear surface 302*r* of the cabinet of the first embodiment could also be designed in the same way as the speaker diaphragm 304 so to better match and complement its output.

Rather than venting via legs of a chassis, dedicated tubes or conduits could be provided instead. For example, separate tubes could be placed at the corners of a square chassis.

Instead of using resilient rings to decouple one part from another part, different means could be employed. For example, a sliding joint could be employed with one part being coupled a first portion of the joint and the other part being coupled to a second portion of the joint, the first and second portions of the joint being slidably connected to each other but otherwise vibrationally decoupled. The positions of such first and second portions would preferably be arranged such that they would be urged towards, or otherwise be arranged to return to, a neutral or rest position.

A dust cap (not shown) may of course be provided in front of the speaker diaphragm and/or voice-coil/sleeve.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

The invention claimed is:

1. A loudspeaker enclosure housing a drive unit, the enclosure being defined by one or more panels, wherein the drive unit comprises a coil, a magnet and a diaphragm, the magnet is decoupled from the one or more panels of the loudspeaker enclosure, and the diaphragm is arranged to move, and thereby generate sound which is emitted forwardly of the diaphragm, on application of an appropriate electrical signal to the coil, which also causes a complementary movement of the magnet, wherein the diaphragm is arranged such that when moved by such an electrical signal it acts against a first air volume within the enclosure, the magnet is arranged such that when moved by such an electrical signal a surface coupled to the magnet acts against a second air volume, different from the first air volume, the second air volume extending rearwardly of the magnet and the surface coupled to the magnet is decoupled from the one or more panels of the loudspeaker enclosure.

2. A loudspeaker enclosure according to claim 1, wherein the second volume is smaller than the first volume.

3. A loudspeaker enclosure according to claim 1, wherein the second volume is located within the enclosure.

4. A loudspeaker enclosure according to claim 3, wherein the second volume is vented to outside the enclosure.

5. A loudspeaker enclosure according to claim 1, wherein the second volume has a depth that is less than ten times the maximum excursion that the magnet is expected to make during normal operation.

6. A loudspeaker enclosure according claim 1, wherein the surface to which the magnet is coupled is defined by means of a structure that has a surface area arranged to act against the second volume of air that is comparable to surface area of the diaphragm.

7. A loudspeaker enclosure according to claim 1, wherein the surface is coupled to the magnet by means of the magnet defining at least part of the surface.

8. A loudspeaker enclosure according to claim 1, wherein the surface is coupled to the magnet via one or more struts.

9. A loudspeaker enclosure according to claim 1, wherein the loudspeaker enclosure includes a resilient mounting such that it is the resilient mounting that causes the magnet to be decoupled from the one or more panels of the loudspeaker enclosure.

10. A loudspeaker enclosure according to claim 9, wherein a first resilient mounting is provided between the magnet and one or more panels of the loudspeaker enclosure and a second resilient mounting is provided between the surface coupled to the magnet and said one or more panels of the loudspeaker enclosure.

11. A loudspeaker enclosure according to claim 1, wherein the enclosure comprises a chassis that defines a rearmost boundary of the second volume.

12. A loudspeaker enclosure according to claim 11, wherein the surface coupled to the magnet is connected to but decoupled from the one or more panels of the loudspeaker enclosure by means of the surface being connected to the chassis via a resilient mounting.

13. A loudspeaker enclosure according to claim 11, wherein the chassis defines vents for venting the second volume.

14. A loudspeaker enclosure according to claim 1, wherein the enclosure is in the form of a free-standing loudspeaker cabinet.

15. A loudspeaker enclosure according to claim 1, wherein the enclosure is in the form of an in-wall loudspeaker installation.

16. A kit for making an in-wall loudspeaker installation according to claim 15, wherein the kit includes a drive unit comprising a coil, a magnet and a diaphragm, the diaphragm being arranged to move, and thereby generate sound, on application of an appropriate electrical signal to the coil, which also causes a complementary movement of the magnet, and one or more fixings for mounting the magnet within the wall in a manner that decouples the magnet from the wall, wherein the kit includes one or more panels for dividing the cavity into a first volume and a second volume, the kit being so arranged that once the loudspeaker is installed in the cavity, the diaphragm acts against the first air volume when moved by such an electrical signal and a surface coupled to the magnet against a second air volume, different from the first air volume, when moved by such an electrical signal.

17. A loudspeaker enclosure having a main body in which there is housed a drive unit, wherein the drive unit comprises a coil, a magnet and a diaphragm, the magnet is decoupled from the main body of the loudspeaker enclosure, the diaphragm is arranged to move, and thereby generate sound which is emitted forwardly of the diaphragm, on application of an appropriate electrical signal to the coil, which also causes a complementary movement of the magnet, the enclosure includes a first structure or group of structures defining a first volume of air within the enclosure, the enclosure includes a second structure or group of structures defining a second volume of air within the enclosure, the second air volume so defined being different from the first air volume so defined and extending rearwardly of the magnet, the diaphragm is arranged such that when moved by such an electrical signal it acts against the first air volume, the magnet is arranged such that when moved by such an electrical signal a surface coupled to the magnet acts against the second air volume, and the surface coupled to the magnet is decoupled from the main body of the loudspeaker enclosure.

18. A loudspeaker enclosure according to claim 17, wherein a first suspension ring is provided to decouple the magnet from the main body of the loudspeaker enclosure and a second suspension ring, separate and spaced apart from the first suspension ring, is provided to decouple the surface coupled to the magnet from the main body of the loudspeaker enclosure.

19. A loudspeaker enclosure having a main body in which there is housed a drive unit, wherein the drive unit comprises a coil, a magnet and a diaphragm, the loudspeaker enclosure comprises a first suspension ring which decouples the magnet from the main body of the loudspeaker enclosure, the diaphragm is arranged to move, and thereby generate sound, on application of an appropriate electrical signal to the coil, which also causes a complementary movement of the magnet, the enclosure includes a first structure or group of structures defining a first volume of air within the enclosure, the enclosure includes a second structure or group of structures defining a second volume of air within the enclosure, the second air volume so defined being different from the first air volume so defined, the diaphragm is arranged such that when moved by such an electrical signal it acts against the first air volume, the magnet is arranged such that when moved by such an electrical signal a surface coupled to the magnet acts against the second air volume, and the loudspeaker enclosure comprises a second suspension ring, separate and spaced apart from the first suspension ring, which decouples the surface coupled to the magnet from the main body of the loudspeaker enclosure.

* * * * *